United States Patent [19]

Cheng et al.

[11] 4,263,151

[45] Apr. 21, 1981

[54] OIL SOLUTIONS AND/OR DISPERSIONS OF HYDRATED CHROMIUM OXIDES

[75] Inventors: William J. Cheng; Donald M. Leiendecker, both of St. Louis, Mo.

[73] Assignee: Petrolite Corporation, St. Louis, Mo.

[21] Appl. No.: 63,228

[22] Filed: Aug. 3, 1979

[51] Int. Cl.[3] ..... C07F 11/00; C10M 1/40

[52] U.S. Cl. ..... 252/33; 260/438.5 R

[58] Field of Search ..... 260/438.5 R; 44/51; 252/33, 389 R

[56] References Cited

U.S. PATENT DOCUMENTS

| | | | |
|---|---|---|---|
| 2,367,470 | 1/1945 | Neely et al. | 252/39 X |
| 2,428,356 | 10/1947 | Chester et al. | 260/438.5 R |
| 2,760,970 | 8/1956 | Le Suer | 260/438.5 R X |
| 2,794,829 | 6/1957 | Waarden et al. | 260/438.5 R X |
| 3,649,659 | 3/1972 | Otto et al. | 260/438.5 R X |
| 3,897,470 | 7/1975 | Sias | 260/438.5 R X |
| 3,932,285 | 1/1976 | Ceprini et al. | 260/438.5 R X |
| 4,076,638 | 2/1978 | Redmore et al. | 252/33 X |
| 4,104,293 | 8/1978 | Redmore et al. | 260/438.5 R |

*Primary Examiner*—Helen M. S. Sneed

*Attorney, Agent, or Firm*—Sidney B. Ring; Hyman F. Glass

[57] ABSTRACT

This invention relates to a process of treating hydrated chromium oxides with aqueous base(s) in the presence of dispersing agent(s) to form upon dehydration a virtually sediment-free oil solution and/or dispersion of hydrated chromium oxide in amounts up to about 20% chromium content. The product formed is a stable, bright, fluid oil-soluble and/or oil-dispersible hydrated chromium oxide upon filtration or centrifugation to remove minimal sediment.

2 Claims, No Drawings

OIL SOLUTIONS AND/OR DISPERSIONS OF HYDRATED CHROMIUM OXIDES

Oil-soluble chromium compositions have been prepared by a wide variety of methods. One composition is described in U.S. Pat. No. 3,932,285 as follows:

"Stable solutions that contain at least 7.5% by weight of dissolved chromium comprise an organic solvent and a mixture of chromium salts that contains at least one chromium salt of a straight-chain aliphatic monocarboxylic acid having 5 to 10 carbon atoms and at least one chromium salt of a branched-chain aliphatic monocarboxylic acid having 5 to 10 carbon atoms."

U.S. Pat. No. 4,104,293 describes and claims a method for the preparation of oil-soluble chromium compositions containing high chromium concentrations such as for example from about 15 to 30% chromium. The process of U.S. Pat. No. 4,104,293 comprises reacting hydrated chromium oxide with a solution of a sulfonic acid or with a sulfonic acid in conjunction with a carboxylic acid. Although not essential, it is advantageous to have water present in U.S. Pat. No. 4,104,293 since it facilitates more efficient dispersion; then the reaction mixture is heated and the solvent and water present are removed by distillation.

We have now discovered that the process of U.S. Pat. No. 4,104,293 can be further improved by employing aqueous base in the process prior to the dehydration step.

The use of aqueous base in the process results in a product and process which is improved in the following ways:

(1) It reduces substantially the amount of sediment of undispersed hydrated chromium oxide to be removed from the reaction product.

(2) After filtration or centrifugation to remove the minimal solids content, the resulting product is more stable upon dilution and subsequent standing.

(3) There is virtually no sediment to be removed when the starting hydrated chromium oxide is free of chromium oxide anhydrous form.

Although we do not wish to be bound by theoretical considerations, it is believed that the action of aqueous base yields stable oil solutions and/or dispersions of hydrated chromium oxide which results from the in situ formation of highly porous submicron sized hydrated chromium oxide ($Cr_2O_3.H_2O$) owing to the action of the base in a water solution and concomitant dispersion and stabilization by the action of the dispersing agent. Upon dehydration, a virtually sediment-free, clear, bright oil-soluble chromium oxide hydrate dispersion product is obtained.

A wide variety of dispersing agents can be employed for example sulfonic acids of the idealized formula $RSO_3H$ where R is preferably a hydrocarbon moiety, having for example about 10 to 60 carbons, such as from about 12 to 50, for example from about 12 to 40, but preferably only 14 to 30 carbons.

Examples of hydrocarbon moieties of the sulfonic acids include alkyl, aryl, alkaryl, aralkyl, cycloalkyl, etc. groups, as illustrated by the following examples:

octyl
decyl
dodecyl
tetradecyl
hexadecyl
octadecyl octylphenyl
nonylphenyl
decylphenyl
dodecylphenyl
tetradecylphenyl
dipropylnaphthyl
dibutylnaphthyl
dioctylnaphthyl, etc.

Although a hydrocarbon moiety which has a molecular weight of less than about 300 is preferred, the higher sulfonic acid may be employed.

The sulfonic acid may also have more than one $SO_3H$ group, for example $R(SO_3H)_n$.

Although not required, carboxylic acids may be employed in conjunction with sulfonic acids. Suitable carboxylic acids which can be used in preparing hydrated chromium oxide dispersions include naphthenic acids, such as the substituted cyclopentane monocarboxylic acids, the substituted cyclohexane monocarboxylic acids and the substituted aliphatic polycyclic monocarboxylic acids containing at least 15 carbon atoms. Specific examples include cetyl cyclohexane carboxylic acids, dioctyl cyclopentane carboxylic acids, dilauryl decahydronaphthalene and stearyl-octahydroindene carboxylic acids and the like and oil-soluble salts thereof. Suitable oil-soluble fatty acids are those containing at least about 8 carbon atoms. Specific examples include 2-ethyl hexanoic acid, pelargonic acid, oleic acid, stearic acid, palmitoleic acid, linoleic acid and ricinoleic acid. Naturally occurring mixtures of predominantly unsaturated fatty acids, such as tall oil fatty acids, are particularly suitable. Examples of commercially available tall oil fatty acids include the "Crofatols," available from Crosby Chemical Company and the "Acintols," available from Arizona Chemical Company.

The molar ratio of sulfonic acids to carboxylic acids can vary widely, such as from about 10:1 to 1:10, for example from about 5:1 to 1:5, but preferably from about 4:1 to 1:4.

Volatile solvents employed are hydrocarbon solvents having a boiling point even at normal atmospheric pressure of less than about 500° F. Some specific examples of such solvents are: petroleum naptha, hexane, heptane, octane, kerosene, benzene, toluene, aromatic solvents, glycol ethers, monohydric alcohols containing from about 1 to about 6 carbon atoms and the like. Very desirable solvents are hexane, heptane, kerosene, benzene, toluene, xylene, aromatic solvents, butanols and the monomethyl ether of ethylene glycol.

Suitable hydrated chromium oxides useful in this invention can be characterized by x-ray diffraction patterns. Using $CuK_{1,2}$ source 1.5405 and nickel filter the following spacings were obtained for a hydrated chromium oxide.

3.25–3.35
2.30–2.45
1.94–1.96
1.48–1.50

A suitable hydrated chromium oxide such as Hercules X-1010 gave following analysis: $Cr_2O_3$ 79%, water of hydration 14%, moisture 3%, $B_2O$ 3.5%, Na 0.5%.

Hydrated chromium oxides useful herein are prepared by reduction of dichromates for example with boric acid or reducing agents such as sulfur or carbon. It appears that roasting as is commonly employed in preparing chromium oxide pigments is undesirable.

A wide variety of bases in aqueous solution can be employed in the practice of this invention. In general, the base is employed in its commercial form by adding it to water in the reactor. The resulting dilution of the base is less than about 50% solution, such as less than about 40% solution but preferably from about 0.1% to 40% solution.

Illustrative inorganic bases include the following: alkali metal and ammonium hydroxides, alkali metal and ammonium carbonates, bicarbonates, etc.

Illustrative organic bases include the amines having some water solubility such as the following: Diethylamine, triethylamine, ethylene diamine, pyridine, etc.

The stoichiometric ratio of base to $Cr_2O_3.H_2O$ equivalents employed is at least about 0.001 such as from about 0.001 to 0.25, for example from about 0.01 to 0.15, preferably from about 0.02 to 0.15 with an optimum of from about 0.03 to 0.11.

The following examples are presented for purposes of illustration and not of limitation.

Examples 2 through 14 indicate the unique ability of the aqueous alkaline-containing agent to effect virtually complete dispersion of the $Cr_2O_3.H_2O$ content in commercial sources of chromium oxide hydrate. In Example 8, a source of chromium oxide hydrate which was free of $Cr_2O_3$ in anhydrous form was employed, whereupon the aqueous alkaline-containing agent was then able to disperse virtually 100% of the chromium oxide hydrate with no visible sediment remaining.

Example 1 which did not employ an aqueous alkaline-containing agent is included for contrast to Examples 2 through 14. The conversion of chromium oxide hydrate into dispersed chromium oxide hydrate in Example 1 was judged to be poor owing to the absence of the aqueous alkaline-containing agent during the processing, which resulted in an incomplete particle-size reduction of the starting chromium oxide hydrate.

EXAMPLE 1

(No alkaline-containing agent employed)

To a 500 ml. glass reactor fitted with agitator and thermometer were charged 34.4 g dodecylbenzenesulfonic acid, 79 g kerosene, 60 g aromatic solvent, and 22.4 g $H_2O$. With the agitator on and the heat at 50° C., 69 g of commercial hydrated $Cr_2O_3$ containing about 5% (3.5 g) anhydrous $Cr_2O_3$, which is not capable of dispersion was added to the mixture. The contents were stirred at reflux temperature for 2.5 hours. After the water was removed by distillation, the contents of the reactor weighed 233.2 g. Centrifugation of the contents gave sediment weighing 11.7 g. The fluid supernatant dispersion weighed 221.5 g. A Cr analysis of the supernatant indicated an oil-dispersed Cr content at 12.3% or 27.3 g. This calculates to 75.2% incorporation of the dispersible chromium oxide hydrate which was charged.

EXAMPLE 2

(NaOH employed)

The procedure described in Example 1 was repeated but adding 6.0 g 50% to the mixture. The material obtained after reaction and distillation weighed 226.5 g. Upon centrifugation a sediment weighing 4.5 g wet had separated. The stable fluid supernatant dispersion weighed 222 g. A Cr analysis of the supernatant indicated an oil-dispersed Cr content at 16.0% or 35.5 g Cr. This calculates to 98% incorporation of the dispersible chromium oxide hydrate which was charged.

EXAMPLE 3

(NaOH employed)

To a 500 ml. glass reactor fitted with agitator and thermometer were charged 34.4 g dodecylbenzenesulfonic acid, 79 g kerosene, 60 g aromatic solvent, 50 g $H_2O$, 3.0 g 50% NaOH, and 9 g isobutanol. With the agitator on and heat at 55° C., 70 g of commercial hydrated $Cr_2O_3$ containing about 5% (3.5 g) anhydrous Crhd $2O_3$, which is not capable of dispersion was added to the mixture. The contents were stirred at the reflux temperature for 3 hours. After water and isobutanol were removed by distillation, the contents of the reactor weighed 223.4 g. Centrifugation of the contents gave sediment weighing 3.6 g wet. The stable fluid supernatant dispersion weighed 219.8 g. A Cr analysis of the supernatant indicated an oil-dispersed Cr content at 16.4% or 36.0 g. This calculates to 97.9% incorporation of the dispersible chromium oxide hydrate which was charged.

EXAMPLE 4

(NaOH employed)

The procedure described in Example 3 was repeated using isopropanol in place of isobutanol. The material obtained after reaction and distillation weighed 216.9 g. Upon centrifugation, a sediment weighing 3.7 g wet had separated. The stable fluid supernatant dispersion weighed 213.2 g. A Cr analysis of the supernatant indicated an oil-dispersed Cr content at 17.2% or 36.7 g. This calculates to 99.8% incorporation of the dispersible chromium oxide hydrate which was charged.

EXAMPLE 5

(NaOH employed)

The procedure described in Example 3 was repeated using 18 g of 50% NaOH in place of 3 g of 50% NaOH. Upon centrifugation the stable viscous supernatant dispersion weighed 219.3 g. A Cr analysis of the supernatant indicated an oil-dispersed Cr content at 16.6% or 36.4 g. This calculates to 98.9% incorporation of the dispersible chromium oxide hydrate which was charged.

EXAMPLE 6

(Ammonium Carbonate employed)

The procedure described in Example 2 was repeated using 1.2 g $(NH_4)_2CO_3$ in place of 3 g 50% NaOH. Upon centrifugation, the stable fluid supernatant dispersion weighed 192.3 g. A Cr analysis of the supernatant indicated an oil-dispersed Cr content at 18.3% or 35.2 g. This calculates to 96.4% incorporation of the dispersible chromium oxide hydrate which was charged.

EXAMPLE 7

(Ammonium Carbonate employed)

The procedure described in Example 3 was repeated using 69 g instead of 34.4 g of dodecylbenzenesulfonic acid and 2 g of $(NH_4)_2CO_3$ in place of 3 g 50% NaOH. The commercial sample of hydrated $Cr_2O_3$ which was used contained about 2% anhydrous $Cr_2O_3$ or 1.4 g, which is not capable of dispersion. The resultant material obtained was a fluid dispersion of hydrated $Cr_2O_3$ or 210 g. Upon centrifugation, the stable fluid supernatant dispersion weighed 208.1 g. A Cr analysis of the supernatant indicated an oil-dispersed Cr content at 18.1% or 37.6 g. This calculates to virtually 100% incorporation of the dispersible chromium oxide hydrate which was charged.

EXAMPLE 8

(Ammonium Carbonate employed)

To the reactor of Example 3 were charged 34.5 g dodecylbenzenesulfonic acid, 100 g kerosene, 20 g aromatic solvent, 50 g $H_2O$, 9 g isobutanol and 1.2 g $(NH_4)_2CO_3$. With the agitator on and heat at 55° C., 50 gms. of hydrated $Cr_2O_3$ (containing no anhydrous $Cr_2O_3$) was added to the mixture and taken to reflux and maintained there for 2 hours. Water and isobutanol were removed by distillation. The stable fluid contents of the reactor weighed 188.5 g, and upon centrifugation gave no visible sediment. The Cr content of the stable fluid dispersion was 14.5%, a virtually 100% incorporation of the dispersible chromium oxide hydrate charged.

EXAMPLE 9

(Ammonium formate employed)

To the reactor of Example 3 were charged 34.5 g dodecylbenzenesulfonic acid, 100 g kerosene, 20 g aromatic solvent, 50 g $H_2O$, 9 g isobutanol and 1.2 g ammonium formate. With the agitator on and heat at 55° C., 70 g of commercial hydrated $Cr_2O_3$ (containing about 3% anhydrous $Cr_2O_3$ or 2.1 g, which is not capable of dispersion) was added to the mixture and taken to reflux. The rest of the procedure as described in Example 1 was then followed. Upon centrifugation of the reaction mass, the stable fluid supernatant dispersion weighed 205.3 g. A Cr analysis of the supernatant indicated an oil-dispersed Cr content at 18.2% or 37.4 g. This calculates to 99.6% incorporation of the hydrated chromium oxide which was charged.

EXAMPLE 10

(Diethanolamine employed)

The procedure described in Example 9 was repeated using 1.3 g diethanolamine in place of 1.2 g ammonium formate. Upon centrifugation of the reaction mass, the stable fluid supernatant dispersion weighed 205.4 g. A Cr analysis of the supernatant indicated an oil-dispersed Cr content at 18.1% or 37.1 g. This calculates to 99.1% incorporation of the hydrated chromium oxide which was charged.

EXAMPLE 11

(Triethylamine employed)

The procedure described in Example 9 was repeated using 1.2 g of triethylamine in place of 1.2 g ammonium formate. Upon centrifugation of the reaction mass, the stable fluid supernatant dispersion weighed 203.0 g. A Cr analysis of the supernatant indicated an oil-dispersed Cr content at 18.55% or 37.7 g. This calculates to virtually 100% incorporation of the dispersible chromium oxide hydrate which was charged.

EXAMPLE 12

(Ethylenediamine employed)

To a 1,000 ml glass reactor fitted with agitator and thermometer were charged 80 g dodecylbenzenesulfonic acid, 200 g kerosene, 44 g aromatic solvent, 110 g $H_2O$, 26 g isobutanol and 1.6 g ethylenediamine. The procedure described in Example 7 was repeated using 160 g of commercial hydrated $Cr_2O_3$ (containing about 3% anhydrous $Cr_2O_3$). Upon centrifugation of the reaction mass, the stable fluid supernatant dispersion weighed 459.0 g. A Cr analysis of the supernatant indicated an oil-dispersed Cr content at 18.13% or 83.2 g. This calculates to 96.9% incorporation of the hydrated chromium oxide which was charged.

EXAMPLE 13

(Ammonium Hydroxide employed)

The procedure described in Example 3 was repeated using 4.4 g 29% $NH_3$ in place of 50% NaOH. The material obtained after reaction and distillation weighed 222.0 g. Upon centrifugation, a sediment weighing 3.0 g wet had separated. The stable fluid supernatant dispersion weighed 219.0 g. A Cr analysis of the supernatant indicated an oil-dispersed Cr content at 15.80% or 34.6 g. This calculates to 94% incorporation of the dispersible chromium oxide hydrate which was charged.

EXAMPLE 14

(Ammonium Hydroxide employed)

The procedure described in Example 3 was repeated except for using 2.2 g 29% $NH_3$ in place of 3.0 g 50% NaOH, and using 70 g of commercial hydrated $Cr_2O_3$ which contained 2% anhydrous $Cr_2O_3$ or 1.4 g, which is not capable of dispersion. The material obtained after reaction and distillation weighed 202.4 g. Upon centrifugation, a sediment weighing 4.8 g wet had separated. The stable fluid supernatant weighed 197.6 g. A Cr analysis of the supernatant indicated 18.16% or 35.9 g. This calculates to 96% incorporation of the dispersible chromium oxide hydrate which was charged.

The following table shows the enhanced stability of oil-soluble chromium compositions when made by the procedure employing an alkaline-containing agent.

TABLE

Stability of Two Contrasting Preparations of Oil Dispersible Chromium Oxide Hydrate

| | Not Employing Alkaline Agent (Example 1) | Employing Alkaline-Containing Agent (Example 14) |
|---|---|---|
| A. Procedure | | |
| Alkaline Agent | None | $NH_4OH$ |
| % Cr Theory | 16.36% | 18.54% |
| Total Insolubles | 5.0% | 2.4% |
| Insolubles from anhydrous $Cr_2O_3$ | 1.5% | 0.7% |
| Net insolubles from undispersed hydrated $Cr_2O_3$ | 3.5% | 1.7% |
| % Cr in product after centrifuging | 12.3% | 18.16% |
| Additional (cumulative) in solubles separating after: | | |
| Two months | 0.35% | Trace % |
| Six months | 0.40% | Trace % |
| Seven months | 0.40% | Trace % |
| Appearance | slightly cloudy some chrome still adhering to the side especially at the bottom of the centrifuge tube. | Clear-bright |
| B. Dilution with Xylene | | |

TABLE-continued

| Stability of Two Contrasting Preparations of Oil Dispersible Chromium Oxide Hydrate | | |
|---|---|---|
| | Not Employing Alkaline Agent (Example 1) | Employing Alkaline-Containing Agent (Example 14) |
| % Cr after dilution | | |
| Stability as % insolubles (cumulative) separating after: | 8.48% | 8.0% |
| 1st day | 0.65% | Trace % |
| 2nd day | 0.65% | Trace % |
| 3rd day | 0.85% | Trace % |
| 4th day | 0.90% | Trace % |
| 5th day | 1.40% | Trace % |
| 2 months | 1.75% | Trace % |

Although the chromium-containing compositions of this invention are strictly speaking dispersions, their behavior resembles that of solutions. Thus, the compositions are clear to the naked eye and can be diluted with oils such as hydrocarbon solvents to give clean solutions on dilution and are this considered to be for practical purposes oil-soluble compositions. Thus, the terms solution and dispersion are used interchangeably.

Chromium dispersions produced by the process of the present invention are useful as fuel oil additives, jet fuel additives, motor fuel additives, lubricant additives and the like. The dispersions of the present invention are particularly useful since such dispersions contain substantial amounts of chromium in a clear bright dispersion suitable for use in high quality motor oils and the like.

The compositions of this invention are particularly effective in the inhibition of vanadium corrosion gas turbines.

The fluid dispersions of hydrated chromium oxide are specifically useful for the following:

(a) As a combination anti-corrosion and neutralization additive in the prevention of sulfidation resulting from the combustion of fuels having a high sodium and sulfur content such as residual fuel, turbine fuels, or pulverized coal or mixtures thereof.

(b) As a combination anti-corrosion, anti-wear and neutralization additive for lubricating oils and greases.

(c) As a pigment for oil soluble formulations such as paints.

In summary, this invention relates to the formation of oil soluble and/or dispersible hydrated chromium oxide by the in situ formation of highly porous sub-micron sized hydrated chromium oxide owing to the action of an alkaline agent in a water solution and concomitant dispersion and stabilization by the action of the dispersing agent. The product of this invention upon dehydration and removal of minimal sediment by filtration or centrifugation is a bright fluid oil-soluble and/or oil-dispersible hydrated chromium oxide of up to a 20% chromium content. A sediment-free product is obtained when the starting hydrated chromium oxide used is not contaminated with anhydrous chromium oxide which appears to be unresponsive to the alkaline treatment.

The terms "hydrated chromium oxide" and "chromium oxide hydrate" are used interchangeably.

We claim:

1. A process of preparing oil-soluble and/or dispersible hydrated chromium oxide having a chromium content of up to about 20% which comprises reacting hydrated chromium oxide obtained by the reduction of dichromates, in the presence of a base, a dispersant selected from the group consisting of sulfonic acids of the idealized formula $RSO_3H$ where R is a hydrocarbon moiety having about 10 to 60 carbon atoms and mixtures of said sulfonic acids with a monocarboxylic acid having at least 8 carbon atoms, water and a volatile solvent for a time sufficient to form a solution and/or dispersion thereof and removing the water and solvent therefrom.

2. The process of claim 1 where the dispersant is an organic sulfonate.

* * * * *